US007494254B2

(12) United States Patent
Rogers

(10) Patent No.: US 7,494,254 B2
(45) Date of Patent: Feb. 24, 2009

(54) PULL DOWN LIGHT FIXTURE

(76) Inventor: Elizabeth M. Rogers, 7605 Shoal Creek Blvd., Austin, TX (US) 78757-1645

( * ) Notice: Subject to any disclaimer, the term of this patent is extended or adjusted under 35 U.S.C. 154(b) by 227 days.

(21) Appl. No.: 11/706,091

(22) Filed: Feb. 13, 2007

(65) Prior Publication Data

US 2007/0189023 A1 Aug. 16, 2007

Related U.S. Application Data

(60) Provisional application No. 60/772,960, filed on Feb. 14, 2006.

(51) Int. Cl.
*F21V 21/16* (2006.01)

(52) U.S. Cl. ..... 362/407; 362/408; 362/404; 362/418

(58) Field of Classification Search ..... 362/404, 362/147, 250, 372, 285, 288, 287, 388, 402, 362/406–408, 418, 430, 449; 248/327–329
See application file for complete search history.

(56) References Cited

U.S. PATENT DOCUMENTS 4,851,980 A * 7/1989 McWilliams et al. ..... 362/403
5,519,597 A * 5/1996 Tsai ..... 362/386
5,556,195 A * 9/1996 Glebe ..... 362/386
6,142,439 A * 11/2000 Aramaki ..... 248/327
6,464,190 B1 10/2002 Aramaki
7,033,048 B2 * 4/2006 Sin et al. ..... 362/404

* cited by examiner

*Primary Examiner*—Bao Q Truong
(74) *Attorney, Agent, or Firm*—James Ray & Associates

(57) ABSTRACT

A pull down light fixture having a cover connected to a bottom portion of the light fixture. A power source is connected to the light fixture via a power cord. A power cord base engages a ceiling for housing the power cord. A predetermined plurality of retraction cords are connected to the cover for at least one of raising and lowering the cover. A retraction cord mechanism is connected to each retraction cord for enabling such retraction cords to at least one of extend and retract. A predetermined plurality of retraction cord bases engage the ceiling for housing each retraction cord and retraction cord mechanism. A pull down attachment is connected to the light fixture for enabling the light fixture to be pulled down.

18 Claims, 2 Drawing Sheets

PULL DOWN LIGHT FIXTURE

CROSS REFERENCE TO RELATED APPLICATION

This application is closely related to and claims priority from U.S. Provisional Patent Application Ser. No. 60/772,960 filed on Feb. 14, 2006, and its teachings are incorporated into the present document by reference thereto.

FIELD OF THE INVENTION

The present invention relates, in general, to light fixtures and, more particularly, the invention relates to a light fixture on a ceiling of any height in which the light fixture can be manually lowered and raised a predetermined distance from the ceiling.

BACKGROUND OF THE INVENTION

Prior to the conception and development of the present invention, as is generally well known in the prior art, light bulbs are used in practically every room of a home or office and must be replaced every so often. Climbing up a ladder or balancing on a chair to change burned out bulbs in a high ceiling fixture can be quite difficult and dangerous for anyone, even possibly resulting in injury to those involved.

SUMMARY OF THE INVENTION

The present invention provides a pull down light fixture including a light fixture having a pre-selected number of light bulb receptacles. A light cover is connected to a bottom portion of the light fixture to provide a decorative housing over such light fixture. There is a power cord having a first end connected to a power source and a second end connected to the light fixture for providing power to such light fixture. A power cord base engages a ceiling for housing the power cord therein. Further included are a predetermined plurality of retraction cords having a first end connected to the light cover for at least one of raising and lowering such light cover. A retraction cord means is connected to a second end of each of the retraction cords for enabling them to at least one of extend and retract. A predetermined plurality of retraction cord bases engage such ceiling for housing each of the retraction cords and retraction cord means. A pull down attachment is also included having one end connected through the light cover and into such bottom portion of the light fixture for enabling such light fixture to be pulled down.

OBJECTS OF THE INVENTION

It is, therefore, one of the primary objects of the present invention to provide a pull down light fixture connected to a high ceiling that is easily lowered and raised.

Another object of the present invention is to provide a pull down light fixture connected to a high ceiling that can be manually lowered and raised without having to climb onto a ladder or chair.

A further object of the present invention is to provide a pull down light fixture connected to a high ceiling that can be manually lowered and raised from floor level.

Yet another object of the present invention is to provide a pull down light fixture connected to a high ceiling that simplifies the process of changing light bulbs.

Still another object of the present invention is to provide a pull down light fixture that is relatively easy to use.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
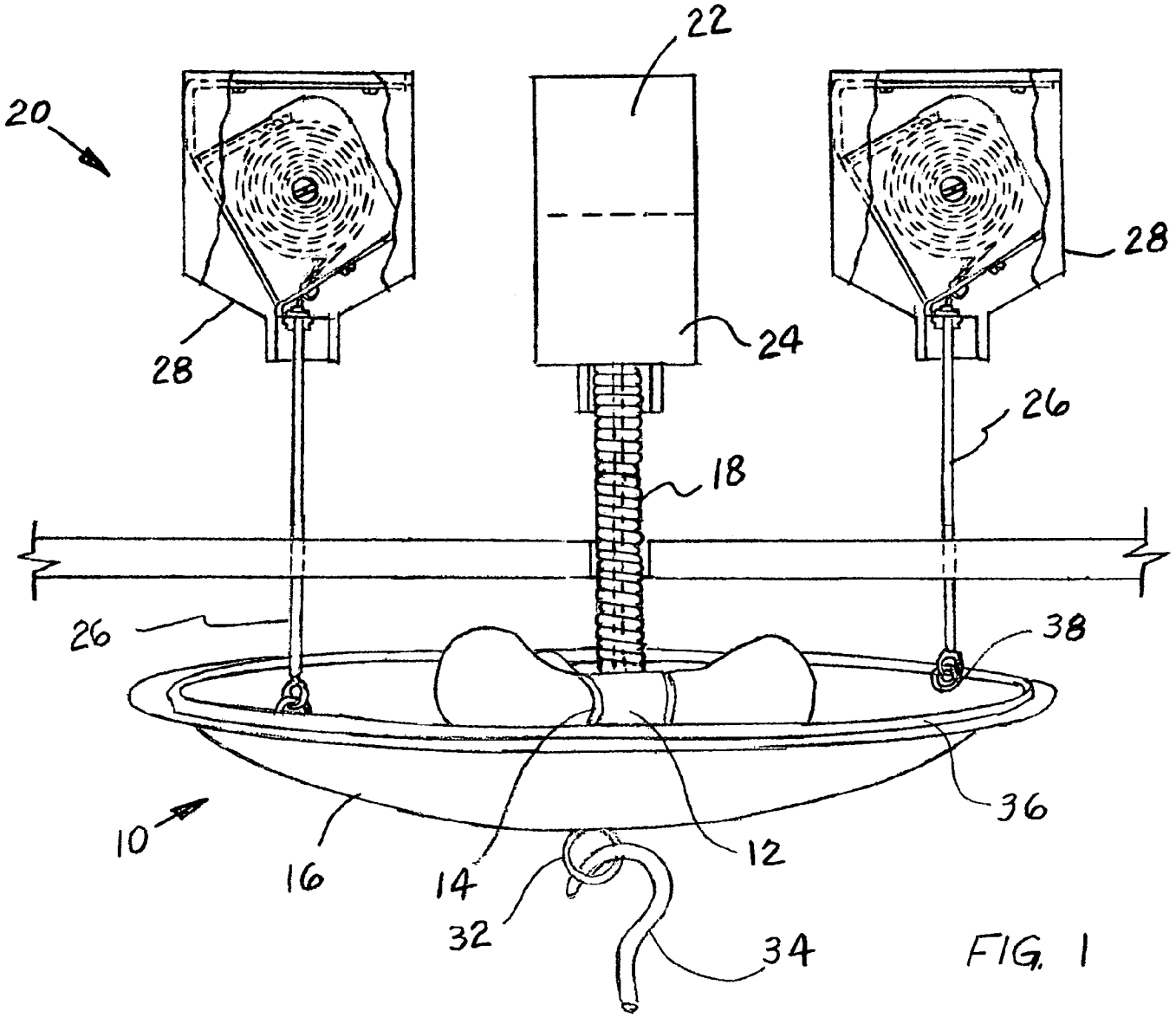
FIG. 1 is a side cut-away view of a pull down light fixture showing the elements hidden within a ceiling and a hook member engageable with a pull down attachment of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
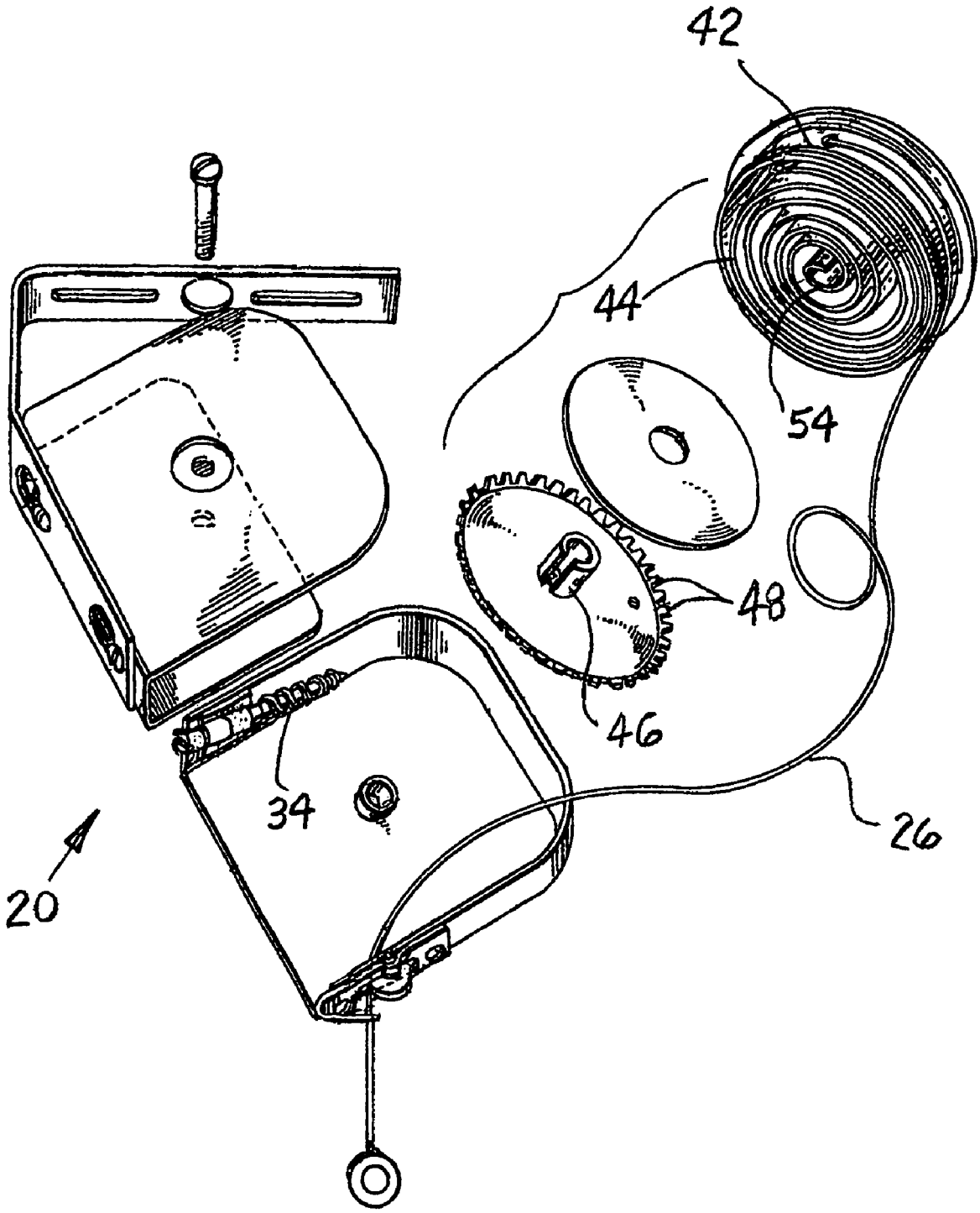
FIG. 2 is an exploded perspective view of a retraction cord means used to lower and raise the pull down light fixture of the present invention.

Reference is now made, more particularly, to drawing FIGS. 1 and 2. Illustrated therein is a pull down light fixture, generally designated 10, constructed according to a presently preferred embodiment of the invention. The pull down light fixture 10 includes a light fixture 12 having a pre-selected number of light bulb receptacles 14. Light fixture 12 is designed to hold at least one of an incandescent and a fluorescent light bulb(s).

A light cover 16 is connected to a bottom portion of the light fixture 12 for providing a decorative housing over such light fixture 12. The light cover 16 is, preferably, made from either glass or plastic, and may also include a decorative metal rim.

There is a power cord 18 having a first end connected to a power source 22 and a second end connected to light fixture 12 for providing power to the light fixture 12. The power cord 18 is, preferably, a coiled type cord containing electrical conductors and having a heat protective covering. A power cord base 24 engages a ceiling for housing the power cord 18 therein.

Further included is a predetermined plurality of retraction cords 26, preferably at least two, having a first end connected to the light cover 16 for at least one of raising and lowering such light cover 16. Each retraction cord 26 may be either a flexible multi strand metallic cord or a flexible elastomeric cord. It is presently preferred, however, that each of the retraction cords 26 be flexible multi strand metallic cords having a heat protective covering.

A retraction cord means, generally designated 20, is connected to a second end of each of the retraction cords 26 for enabling them to at least one of extend and retract. The retraction cord means 20 used may be one of a tension reel mechanism, a lock and release mechanism, a spring powered drum or an adjustable friction system. However, it is presently preferred that the retraction cord means 20 be the tension reel mechanism illustrated in FIG. 2.

Also included are a predetermined plurality of retraction cord bases 28 engageable with such ceiling for housing each of the retraction cords 26 and retraction cord means 20, respectively. Each retraction cord means 20 is, preferably, removeably engageable with each retraction cord base 28 for easy maintenance or replacement of the retraction cord means 20.

A pull down attachment 32 is connected at one end through the light cover 16 and into such bottom portion of the light fixture 12 for enabling light fixture 12 to be pulled down. The pull down attachment 32 includes an aperture at the other end thereof for receiving a hook member 34 having a predetermined length.

The light cover 16, preferably, has a metallic rim 36 disposed thereon located a predetermined distance from an exterior edge of the light cover 16. Such metallic rim 36, preferably, has a predetermined plurality of ring members 38 disposed thereon for connecting to the first end of each of such retraction cords 26.

Also, preferably, the light cover 16 has a protective radiant barrier disposed on an exterior thereof for protecting the power cord 18 and retraction cords 26 from heat produced by such pre-selected number of light bulbs.

The operation of each retraction cord means 20 of pull down light fixture 10, illustrated in FIG. 2, will now be described. The light fixture 12 is supported entirely by each retraction cord 26 and, therefore, no weight is placed on the power cord 18. By placing the hook member 34 through the aperture of pull down attachment 32 and pulling down on same, the retraction cord 26 will cause the tension reel mechanism, shown in FIG. 2, to rotate clockwise thereby unwinding the retraction cord 26 which is coiled on a ring 42 and thus lower light fixture 12. As the reel rotates clockwise, a spring 44 which has one end affixed thereto will likewise rotate with the reel. The opposite or inner end of the spring 44 is secured to a split sleeve 46 on a worm gear 48 which remains stationary, hence the spring 44 will be tensioned with the clockwise rotation of the reel. The light fixture 12 even with spring 44 tensioned will remain suspended at any point when released and will not move upwardly or downwardly.

By manually raising the light fixture 12 the tensioned spring 44 will urge the reel to rotate counterclockwise and cause the retraction cord 26 to wind on the reel and shorten its length thus raising the light fixture 12 to any desired elevation below the support. Merely releasing light fixture 12 will cause the reel to stop its rotation.

It may be necessary to adjust the tension of the spring 44 to compensate for different weights of lighting fixtures that need supported. This may be accomplished by rotating a worm 52 which in turn rotates worm gear 48 and its split sleeve 46 to tension the spring 44 since lip 54 of the inner end of the spring 44 is secured to the sleeve 46. Rotating the worm 52 clockwise will rotate worm gear 48 counterclockwise and tighten the tension on the spring 44. Rotation in the opposite direction will, of course, loosen the spring 44.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A pull down light fixture comprising:

(a) a light fixture having a pre-selected number of light bulb receptacles;

(b) a light cover connected to a bottom portion of said light fixture for providing a decorative housing over said light fixture;

(c) a power cord having a first end connected to a power source and a second end connected to said light fixture for providing power to said light fixture;

(d) a power cord base engageable with a ceiling for housing said power cord therein;

(e) a predetermined plurality of retraction cords having a first end connected to said light cover for at least one of raising and lowering said light cover;

(f) a retraction cord means connected to a second end of each of said retraction cords for enabling said retraction cords to at least one of extend and retract;

(g) a predetermined plurality of retraction cord bases engageable with such ceiling for housing each of said retraction cords and said retraction cord means; and (h) a pull down attachment having one end connected through said light cover and into said bottom portion of said light fixture for enabling said light fixture to be pulled down.

2. A pull down light fixture, according to claim 1, wherein said power cord is a coiled type cord containing electrical conductors.

3. A pull down light fixture, according to claim 1, wherein each of said retraction cords is at least one of a flexible multi strand metallic cord and a flexible elastomeric cord.

4. A pull down light fixture, according to claim 3, wherein each of said retraction cords is said flexible multi strand metallic cord.

5. A pull down light fixture, according to claim 1, wherein each of said retraction cord means is at least one of a tension reel mechanism, a lock and release mechanism, a spring powered drum and an adjustable friction system.

6. A pull down light fixture, according to claim 5, wherein each of said retraction cord means is said tension reel mechanism.

7. A pull down light fixture, according to claim 2, wherein said coiled type cord has a heat protective covering.

8. A pull down light fixture, according to claim 4, wherein each said flexible multi strand metallic cord has a heat protective covering.

9. A pull down light fixture, according to claim 1, wherein said light cover is made from at least one of glass and plastic.

10. A pull down light fixture, according to claim 9, wherein said light cover is made from said glass.

11. A pull down light fixture, according to claim 9, wherein said light cover has a metallic rim disposed thereon, said metallic rim located a predetermined distance from an exterior edge of said light cover.

12. A pull down light fixture, according to claim 11, wherein said metallic rim has a predetermined plurality of ring members disposed thereon for connecting to said first end of each of said retraction cords.

13. A pull down light fixture, according to claim 12, wherein said predetermined plurality of retraction cords is at least two.

14. A pull down light fixture, according to claim 1, wherein said light fixture is designed to hold at least one of an incandescent and a fluorescent light bulb.

15. A pull down light fixture, according to claim 1, wherein said pull down attachment includes an aperture at one end thereof for receiving a hook member having a predetermined length.

16. A pull down light fixture, according to claim 1, wherein said light cover has a protective radiant barrier disposed on an exterior of said light cover for protecting said power cord and said retraction cords from heat produced by such pre-selected number of light bulbs.

17. A pull down light fixture, according to claim 4, wherein said predetermined plurality of flexible multi strand metallic cords is at least two.

18. A pull down light fixture, according to claim 1, wherein each said retraction cord means is removeably engageable with said retraction cord base for allowing each said retraction cord means to be one of maintained and replaced.

* * * * *